US007290980B2

(12) United States Patent
Gatley, Jr. et al.

(10) Patent No.: US 7,290,980 B2
(45) **Date of Patent: *Nov. 6, 2007**

(54) DUCT QUICK CONNECT REMOVABLE BLOWER HOUSING APPARATUS

(75) Inventors: William Stuart Gatley, Jr., Cassville, MO (US); Joan Teresa Richter, Breese, IL (US); Michael Lynn Kennedy, Wheaton, MO (US)

(73) Assignee: Jakel Incorporated, Aurora, MO (US)

( * ) Notice: Subject to any disclaimer, the term of this patent is extended or adjusted under 35 U.S.C. 154(b) by 30 days.

This patent is subject to a terminal disclaimer.

(21) Appl. No.: 11/335,309

(22) Filed: Jan. 19, 2006

(65) Prior Publication Data

US 2006/0120865 A1 Jun. 8, 2006

Related U.S. Application Data

(63) Continuation-in-part of application No. 10/767,367, filed on Jan. 28, 2004, now Pat. No. 6,994,517.

(51) Int. Cl.
*F04D 29/52* (2006.01)

(52) U.S. Cl. ..... 415/126; 415/201; 415/214.1

(58) Field of Classification Search ..... 415/126, 415/201, 214.1, 220, 223; 416/244 R; 417/360, 417/423.14

See application file for complete search history.

(56) References Cited

U.S. PATENT DOCUMENTS

| | | | | |
|---|---|---|---|---|
| 2,932,441 | A | 4/1960 | Harp | |
| 3,871,795 | A | 3/1975 | Habdo et al. | |
| 4,775,294 | A | 10/1988 | LaPorte | |
| 4,924,848 | A | 5/1990 | Vaughn | |
| 5,160,293 | A * | 11/1992 | Koukal et al. | 454/69 |
| 5,688,446 | A * | 11/1997 | Glenn | 261/142 |
| 5,992,410 | A | 11/1999 | Raleigh et al. | |
| 6,994,517 | B2 * | 2/2006 | Gatley et al. | 415/126 |

* cited by examiner

*Primary Examiner*—Ninh H. Nguyen
(74) *Attorney, Agent, or Firm*—Thompson Coburn LLP

(57) ABSTRACT

A furnace blower apparatus has a tubular housing that is connected between a heating furnace and an exhaust flue of the furnace. The housing has an interior bore containing a fan assembly for drawing air through the furnace burner chamber on operation of the fan assembly. The housing includes a panel that is removably mounted to a side wall of the housing. The fan assembly is mounted to an interior surface of the panel, whereby the fan assembly can be removed from the interior of the housing by removing the panel from the housing.

20 Claims, 4 Drawing Sheets

DUCT QUICK CONNECT REMOVABLE BLOWER HOUSING APPARATUS

This patent application is a continuation-in-part of patent application Ser. No. 10/767,367 filed Jan. 28, 2004, now U.S. Pat. No. 6,994,517 which is incorporated herein by reference.

BACKGROUND OF THE INVENTION (1) Field of the Invention

The present invention pertains to a furnace blower apparatus having a blower housing with a removable panel to which a fan assembly is mounted. More specifically, the present invention pertains to a furnace blower apparatus having a tubular housing that is connected between a furnace and an exhaust flue of the furnace. The housing has an interior bore containing a fan assembly for drawing air through the furnace burner chamber on operation of the fan assembly. The housing includes a panel that is removably mounted to a side wall of the housing. The fan assembly is mounted to an interior surface of the panel. The panel is held to the housing by a pair of lips on the panel that engage against the interior and exterior surfaces of the housing, whereby the fan assembly can be removed from the interior of the housing by removing the panel from the housing.

(2) Description of the Related Art

A typical heating furnace that is used in heating the interior of a home or other similar dwelling structure basically comprises an enclosure containing a combustion burner, a combustion burner blower, a heat exchanger, and a heat exchanger blower. The combustion burner blower is operative to draw ambient air into the combustion burner where it is mixed with a fuel, for example gas, as the fuel is burned. The combustion burner blower also draws the exhaust byproducts of combustion from the combustion burner and directs the exhaust to an exhaust flue connected with the furnace.

The combustion of the combustion burner heats the heat exchanger. The heat exchanger blower draws ambient air through the heat exchanger where the ambient air is heated by the combustion burner. The heat exchanger blower then directs the heated air into the interior environment of the dwelling, heating the interior environment.

The typical construction of a residential furnace described above usually requires a substantial area in the residential dwelling. The area required by the furnace not only must be large enough to accommodate the furnace, but also must be slightly larger in order to enable a free flow of ambient air into the furnace enclosure to provide air for combustion and air to be heated by the furnace. The larger the dwelling being heated by the furnace, the larger furnace construction must be.

Smaller dwellings, for example manufactured homes or mobile homes, typically do not require a larger furnace construction to provide heat to the interior of the dwelling. Furnaces for smaller dwellings have been designed with a much more compact construction. For example, the combustion burner blower has been designed where a fan assembly that draws air through the combustion burner is contained inside a tubular housing that also functions as part of the exhaust flue. This results in a reduction in the overall size of the furnace, because additional space in the furnace enclosure is not required for a combustion burner blower that is a separate component part from the combustion burner and from the exhaust flue of the furnace.

However, compact furnace constructions such as that described above have drawbacks that are attributed to their compact size. For example, in the compact furnace assembly comprising the fan assembly mounted in the tubular housing that communicates the furnace burner with the exhaust flue, it is necessary to disassemble the tubular housing from its position between the furnace enclosure and the exhaust flue to service or replace the fan assembly. Thus, repair of this type of furnace assembly is time-consuming and difficult.

What is needed to overcome the disadvantages associated with compact furnace constructions is a furnace blower apparatus specifically designed for compact furnace constructions where the fan assembly of the apparatus is easily accessed for servicing of the fan assembly.

SUMMARY OF THE INVENTION

The furnace blower apparatus of the present invention overcomes the disadvantages associated with prior art compact furnace constructions by providing a blower apparatus in which the fan assembly is easily removed from the apparatus for servicing or replacement.

The furnace blower apparatus of the present invention is basically comprised of a tubular housing containing a fan assembly. The tubular housing is dimensioned to fit between a conventional furnace used in smaller dwellings, for example in mobile homes, and an exhaust flue or vent pipe of the furnace that vents exhaust gas from furnace combustion to the exterior environment of the dwelling.

The tubular housing has a cylindrical length with opposite input and output ends. The housing has a hollow interior volume along its length. A cylindrical side wall of the housing has a side wall opening that communicates the interior bore of the housing with the exterior environment of the apparatus. The sidewall has opposite interior and exterior surfaces.

A panel is removably attached to the blower housing side wall. The panel completely covers over the side wall opening. The panel has an interior flange and an exterior flange that project from a side edge of the panel. The two flanges are spaced from each other by the panel edge width, and the spacing defines a slot between the two flanges. A portion of the housing side wall is received in the slot in removably attaching the panel to the housing. Separate fasteners are also employed in removably attaching the panel to the side wall. By removing the separate fasteners the panel can be completely removed from the side wall, exposing the side wall opening.

A circular end wall is provided on the interior surface of the panel. The end wall has a circular air flow aperture at its center. Changing the diameter dimension of the air flow aperture changes the flow rate of air through the housing. Attaching the panel to the housing side wall positions the end wall in the housing interior bore.

The fan assembly is also mounted to an interior surface of the panel. With the panel mounted to the blower housing over the side wall opening, a fan of the fan assembly is centered in the interior bore of the housing. Operation of the fan draws air through the combustion chamber of the furnace and pushes exhaust gases of combustion through the exhaust vent flue of the dwelling.

When servicing of the fan assembly is required, the panel is removed from the side wall of the blower housing. With the fan assembly attached to the interior surface of the panel, the fan assembly is removed from the housing side wall with the panel. This enables the fan to be replaced or serviced outside of the blower housing without removing the portion of the tubular housing between the furnace and the exhaust flue. With the fan assembly replaced or repaired and attached to the interior surface of the panel, replacing the panel on the blower housing positions the fan assembly in the blower housing interior bore and completes the repair or replacement of the fan assembly without requiring removal of the blower housing from between the furnace and the exhaust flue.

BRIEF DESCRIPTION OF THE DRAWING FIGURES

Further features of the invention are set forth in the following detailed description of a preferred embodiment of the invention and in the drawing figures wherein.

DETAILED DESCRIPTION OF THE PREFERRED EMBODIMENT

Figure 1:
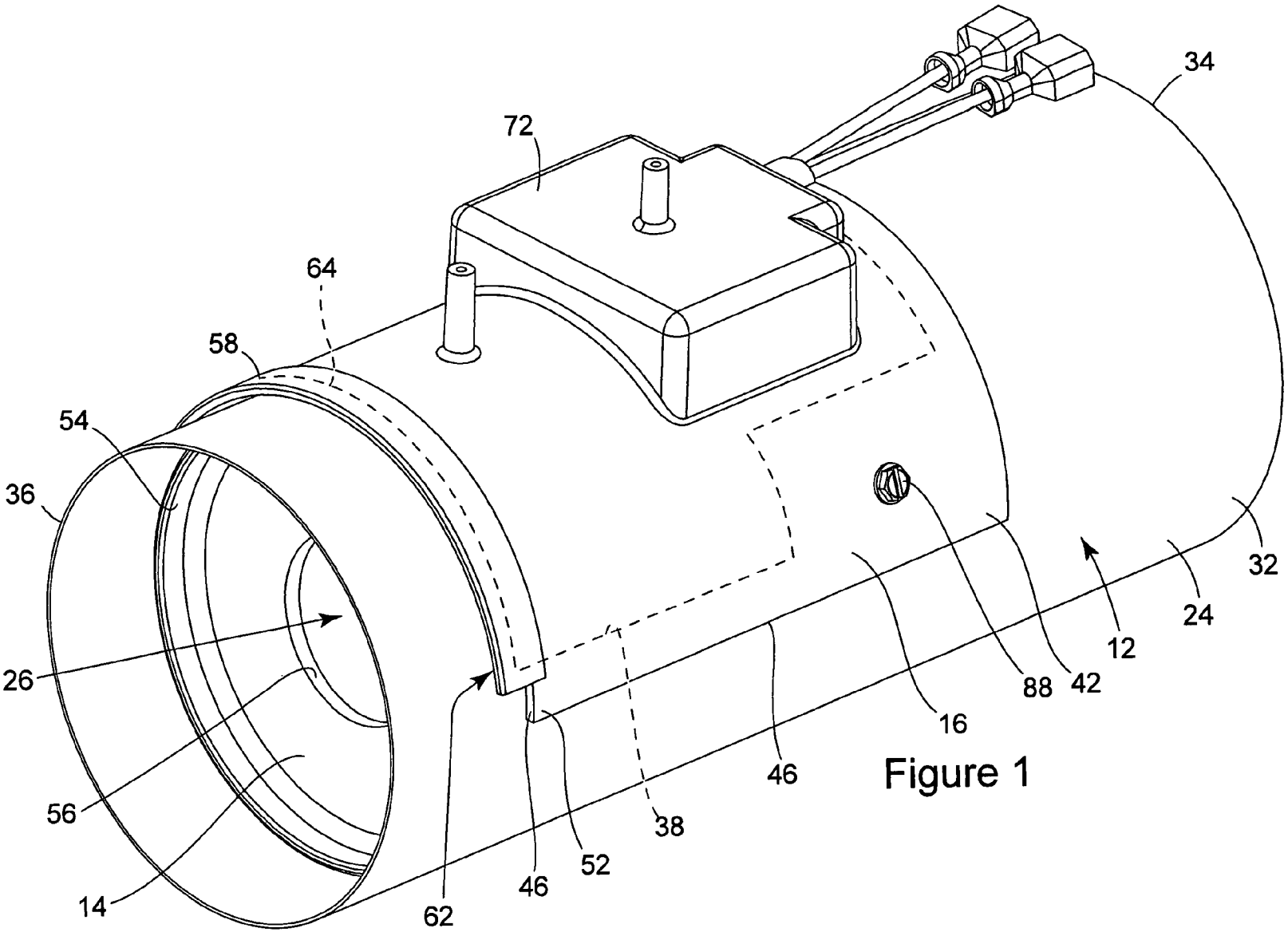
FIG. 1 is a perspective view of the furnace blower apparatus of the invention.

The removable blower housing apparatus of the present invention is show in FIGS. 1-4, and is basically comprised of a blower housing assembly containing a fan assembly. The blower apparatus is designed for use with a furnace for smaller dwellings, such as manufactured homes and mobile homes. However, the blower apparatus may be employed in other environments. The materials employed in manufacturing the blower housing assembly and the fan assembly are not novel aspects of the invention, and therefore materials typically employed in manufacturing conventional furnace blower housings and fan assemblies may be employed in manufacturing the blower housing apparatus of the invention. The blower housing apparatus is basically comprised of a tubular housing 12, a circular end wall 14, and a removable fan assembly panel 16. A fan assembly is attached to the fan assembly panel 16, and the fan assembly is basically comprised of a fan motor 18 and a fan 22.

The tubular housing 12 is comprised of a cylindrical side wall 24 having a length with opposite input and output ends. A hollow interior bore 26 extends through the entire length of the side wall 24. The housing side wall 24 has a cylindrical interior surface 28 that surrounds the interior bore 26. The housing side wall 24 also has a cylindrical exterior surface 32. An annular input end edge 34 of the side wall surrounds an input opening into the side wall interior bore 26. An annular output end edge 36 of the side wall surrounds an output opening into with the side wall interior bore 26. The housing input end edge 34 is adapted to be operatively connected to a furnace to communicate the housing interior bore 26 with combustion gases exhausted from the furnace. The housing output end edge 36 is adapted to be operatively connected with a vent pipe or exhaust flue of a dwelling that exhausts combustion gases from the dwelling.

A side wall opening is provided through the housing side wall 24. The side wall opening is defined by an edge 38 of the side wall that has a generally rectangular configuration. As best seen in FIG. 1, the side wall opening edge 38 extends along a portion of the length of the housing side wall 24 and is spaced from the side wall input end edge 34 and from the side wall output end edge 36. The side wall opening edge 38 also extends around half of the circumference of the housing side wall 24.

The panel 16 is designed to be removably attached to the housing side wall 24 over the side wall opening defined by the opening edge 38. The panel 16 has a curved configuration with opposite exterior 42 and interior 44 surfaces. The panel exterior surface 42 is a convex surface and the panel interior surface 44 is a concave surface. The size of the panel 16 is defined by the rectangular panel outer peripheral edge 46. The panel edge 46 has the same general shape as the side wall opening edge 38, but is slightly larger than the side wall opening edge. This enables the panel 16 to overlap the sidewall opening edge 38.

Figure 2:
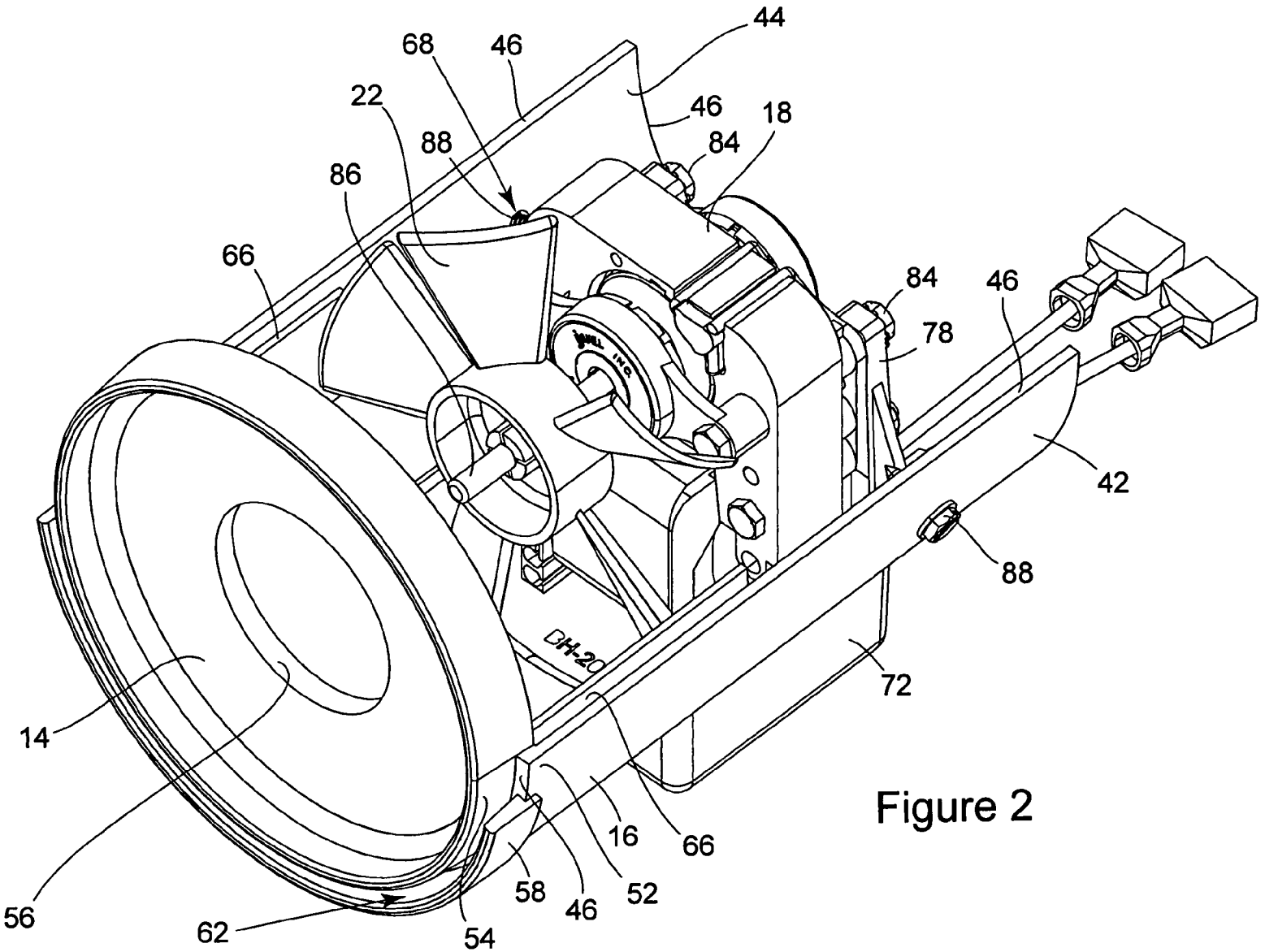
FIG. 2 is a perspective view of the fan assembly panel removed from the housing of the apparatus shown in FIG. 1 and rotated 180 degrees from its position shown in FIG. 1.
Figure 3:
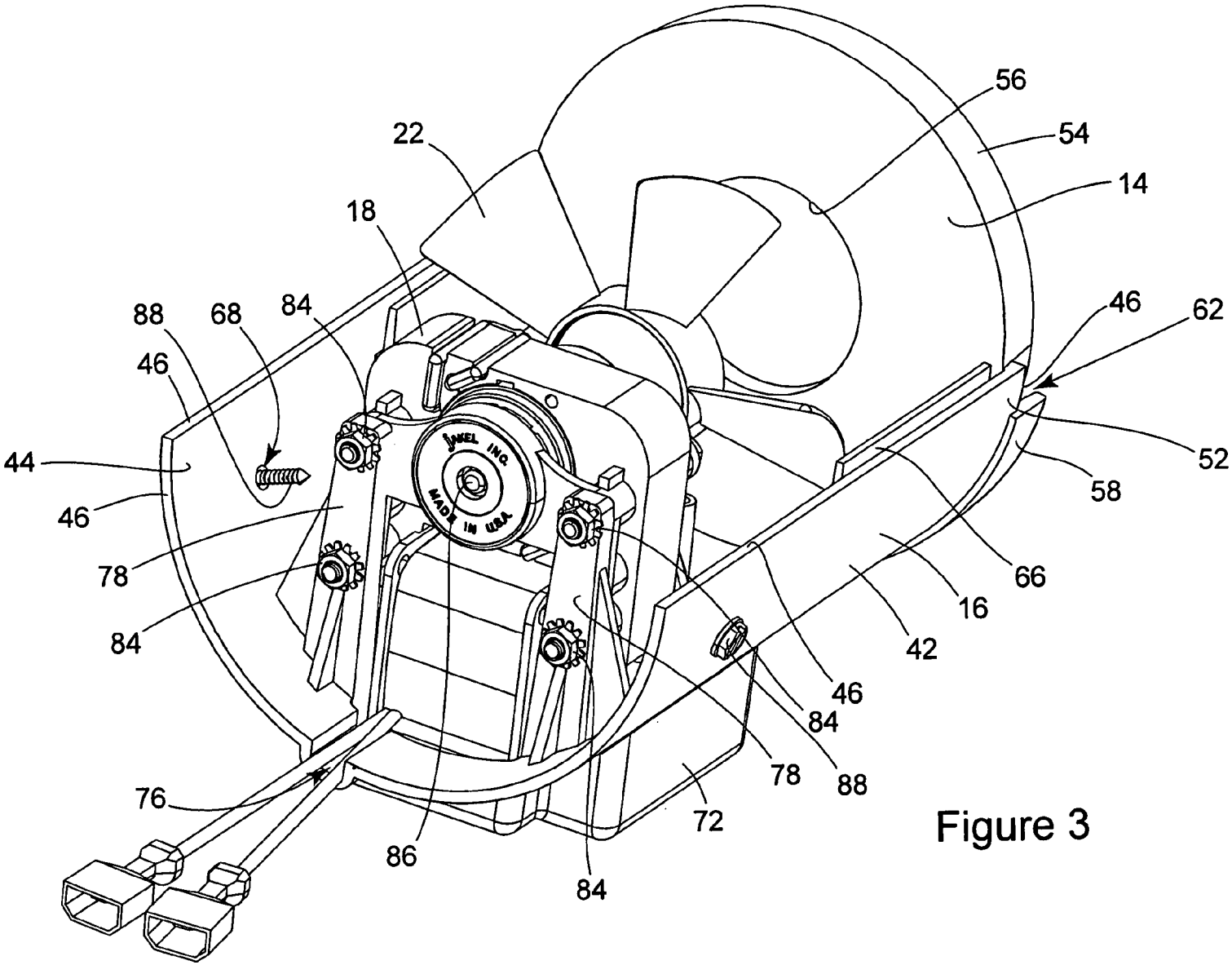
FIG. 3 is a perspective view of the rear of the fan assembly panel shown in FIG. 2; and, FIG. 4 is a view similar to FIG. 3, but with the fan assembly removed from the panel.
Figure 4:
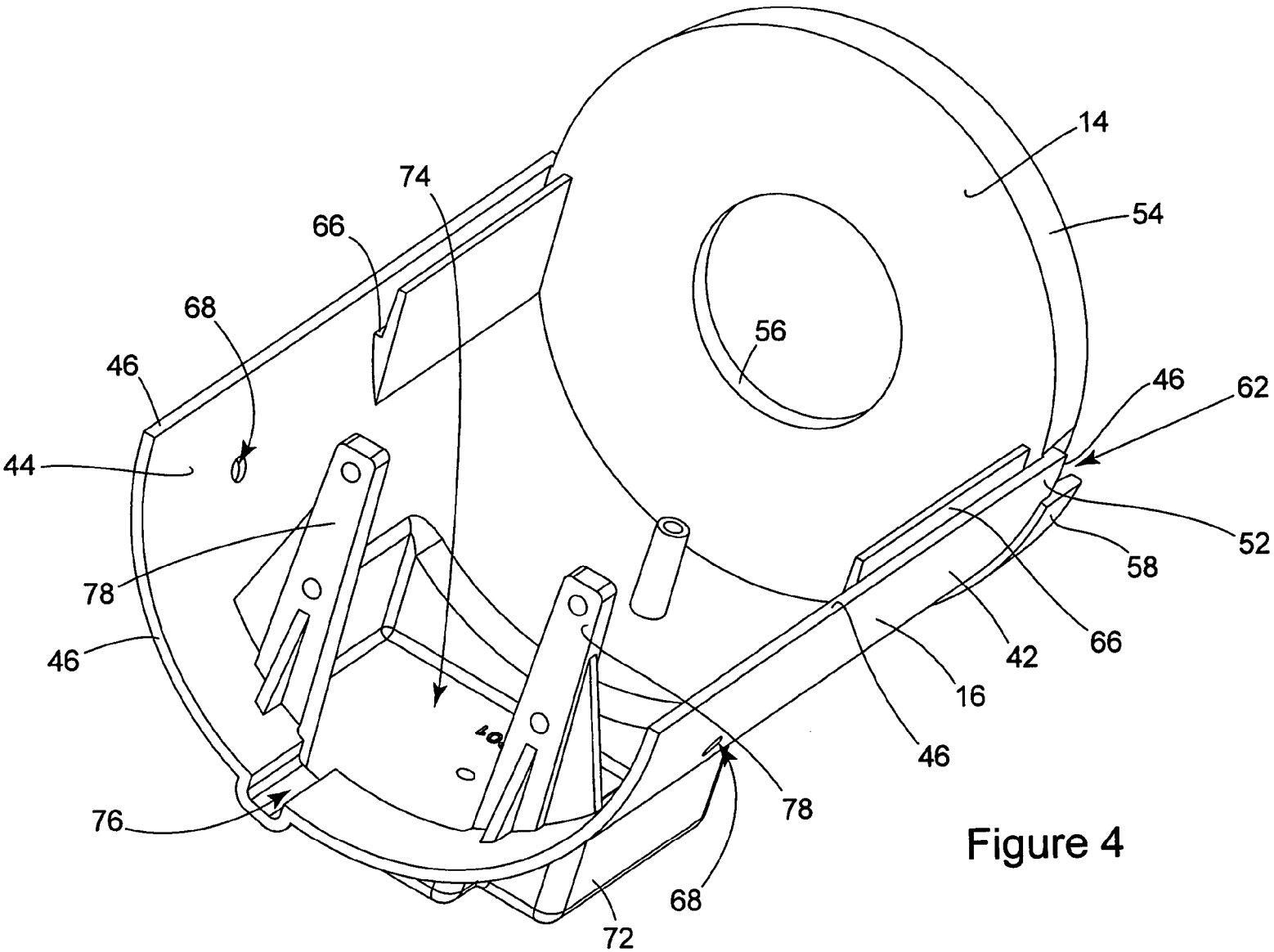

The circular end wall 14 is attached to the interior surface of the panel 16. As seen in FIGS. 2-4, the end wall 14 is positioned adjacent one edge portion 52 of the panel 16. The end wall 14 has a cylindrical rim 54 around its periphery. A portion of the rim 54 projects outwardly from the panel edge portion 52 and forms an interior flange on the panel 16. The exterior diameter dimension of the end wall rim 54 is slightly smaller than the dimension of the housing opening defined by the housing opening edge 38 to allow the end wall 48 and rim 54 to be positioned in the housing interior bore 26.

The circular end wall 14 also has an air flow aperture at its center that is defined by an aperture edge 56 of the end wall. The diameter dimension of the aperture edge 56 determines the rate of air flow through the tubular housing 12. By changing panels 16 having end walls 14 with different size air flow apertures, the rate of air flow through the tubular housing 12 can be adjusted.

An exterior rim in the form of a curved band 58 is secured to the exterior surface of the panel 16 and projects outwardly from the panel edge portion 52. The exterior rim 58 forms an exterior flange that is spaced outwardly from the interior flange 54. Together, the interior flange 54 and the exterior flange 58 define a curved slot 62 at the panel edge portion 52. The curved slot 62 is dimensioned to receive a portion of the tubular housing 64 along a portion of the housing opening edge 38 in removably attaching the panel 16 to the housing 12.

The panel 16 is also provided with a pair of shoulders 66 on its interior surface 44. As seen in FIGS. 2-4, the shoulders 66 are positioned on opposite sides of the panel 16 and extend along portions of the panel peripheral edge 46. The shoulders 66 are also positioned adjacent the circular end wall 14. The shoulders are dimensioned to receive portions of the tubular housing side wall 24 along the housing opening edge 38 when removably attaching the panel 16 to the housing 12.

The panel 16 is also provided with a pair of threaded fastener holes 68 at opposite sides of the panel. The holes 68 receive fasteners in removably attaching the panel 16 to the tubular housing 12.

A motor mount wall 72 projects outwardly from the panel exterior surface 42. The motor mount wall 72 has a shape that is complementary to a shape of the exterior surface of the fan motor 18. The motor mount wall 72 defines a recessed cavity 74 in the panel interior surface 44 that is dimensioned to receive a portion of the fan motor 18. The cavity 74 of the motor mount wall 72 properly positions the fan motor 18 relative to the interior bore 26 of the tubular housing 12 when the panel 16 is attached to the housing 12. A wiring opening 76 extends through the panel edge 46 and communicates with the cavity of the motor mount wall 72. The wiring opening 76 provides a passage for the wiring of the fan motor 18.

A plurality of arms 78 project inwardly from the panel interior surface 44. The arms 78 are positioned on the panel interior surface 44 where they will extend over opposite ends of the fan motor 18 when the fan motor is positioned in the cavity 74 defined by the motor mount wall 72. Each of the arms 78 has an opening (not shown) for accommodating a removable fastener 82 of the fan motor 18.

The fan motor 18 is a conventional motor used in furnace applications for smaller dwellings. A portion of the motor 18 is received in the cavity 74 defined by the motor mount wall 72. This positions removable fasteners 84 of the motor in the openings of the panel arms 78. Threaded bolts and nuts are shown as the motor removable fasteners 84 in the drawing figures. Other equivalent types of fasteners may be used.

The fan 22 is mounted on a shaft 86 of the fan motor 18. The positioning of the fan motor 18 on the panel 16 by the panel arms 78 positions the fan 22 in the center of the tubular housing interior bore 26 when the panel 16 is attached to the housing 12.

In attaching the removable panel 16 and the fan assembly to the tubular housing 12, the fan motor 18 and fan 22 attached to the panel interior surface 44 are inserted through the housing side wall opening defined by the opening edge 38. Portions of the opening edge 38 at opposite sides of the side wall opening are positioned against the panel shoulders 66. The panel is then moved along the length of the housing side wall 24 so that a portion of the housing side wall 64 adjacent the side wall opening edge 38 is received in the panel slot 62 defined by the end wall inner flange 54 and outer flange 58. This removably attaches the panel 16 at the panel slot 62 to the tubular housing 12. To further secure the panel 16 to the tubular housing 12, two threaded fasteners 88 are inserted through the panel fastener holes 68 and are screw threaded into holes (not shown) provided in the housing side wall 24. In this manner, only two threaded fasteners 88 are needed to removably attach the panel 16 to the tubular housing 12.

To service the fan motor 18, it is only necessary to remove the pair of panel threaded fasteners 88. This enables the removable panel 16 to be removed from the tubular housing 12, with the fan motor 18 attached to the panel interior surface 44 being withdrawn from the tubular housing interior bore 26 through the housing side wall opening edge 38. With the fan motor 18 and fan 22 being removed to the exterior environment of the furnace blower apparatus by removing the removable panel 16 from the tubular housing 12, the fan motor 18 and fan 22 can be easily serviced or replaced. When the servicing or replacement is completed, the fan motor 18 and fan 22 are inserted through the side wall opening 38 and the removable panel 16 is reattached to the tubular housing 12 by the threaded fasteners 88.

Although the removable blower housing apparatus of the invention has been described above by reference to one embodiment of the invention, it should be understood that modifications and variations could be made to the described apparatus without departing from the intended scope of the following claims.

The invention claimed is:

1. A blower housing apparatus comprising:

a tubular housing having a cylindrical side wall with opposite input and output ends and opposite interior and exterior surfaces, the interior surface defining a hollow interior bore extending through the housing between the input and output ends;

a panel attached to the housing, the panel having an edge with an interior flange and an exterior flange projecting from the panel edge, the interior flange engaging against the side wall interior surface and the exterior flange engaging against the side wall exterior surface in attaching the panel to the housing; and, a fan assembly attached to the panel and positioned in the housing interior bore, the fan assembly being removable from the housing interior bore by removing the panel from the housing.

2. The apparatus of claim 1, further comprising:

the panel being removably attached to the housing by the interior flange and the exterior flange.

3. The apparatus of claim 1, further comprising:

the panel being removably attached to the housing solely by the interior flange and the exterior flange and a pair of separate fasteners that are removable from the panel.

4. The apparatus of claim 1, further comprising:

the fan assembly including a motor that is attached to the panel in the housing interior bore and a fan that is mounted on the motor for rotation of the fan in the housing interior bore by the motor.

5. The apparatus of claim 4, further comprising:

the panel attached to the housing having an opening; and, the fan assembly having at least one wire that extends from the fan assembly in the housing interior bore, through the opening to an exterior environment of the apparatus.

6. The apparatus of claim 1, further comprising:

the side wall having an opening through the side wall to the housing interior bore; and, the panel being attached to the housing covering over the side wall opening.

7. The apparatus of claim 6, further comprising:

the side wall having an input edge surrounding an input opening at the input end of the housing;

the side wall having an output edge surrounding an output opening at the output end of the housing; and, the side wall opening being spaced between the input edge and the output edge.

8. The apparatus of claim 1, further comprising:

the housing input end being adapted for communication with a heating furnace and the housing output end being adapted for communication with a furnace exhaust.

9. The apparatus of claim 1, further comprising:

the panel having a curved configuration that overlaps the housing cylindrical side wall.

10. The apparatus of claim 9, further comprising:

the panel having opposite convex and concave surfaces, and the fan assembly being attached to the panel concave surface.

11. The apparatus of claim 1, further comprising:

the panel having an interior surface that opposes the housing interior bore; and, the fan assembly being attached solely to the panel interior surface.

12. The apparatus of claim 1, further comprising:

the panel having a circular end wall positioned on the panel adjacent the fan assembly, the end wall having an air flow aperture through the end wall.

13. The apparatus of claim 1, further comprising:

the interior flange and the exterior flange both having curved configurations that define a curved slot between the interior flange and the exterior flange; and, a portion of the housing side wall is inserted into the slot.

14. A furnace blower apparatus comprising:

a tubular housing having a cylindrical side wall with opposite input and output ends and opposite interior and exterior surfaces, the interior surface defining a hollow interior bore extending through the housing between the input and output ends;

a panel attached to the housing, the panel having a peripheral edge and a slot on the panel that extends along the peripheral edge, a portion of the housing side wall being positioned in the slot and attaching the panel to the side wall; and, a fan assembly attached to the panel and positioned in the housing interior bore, the fan assembly being removable from the housing interior bore by removing the panel from the housing.

15. The apparatus of claim 14, further comprising:

the panel being removably attached to the housing solely by the slot and by a pair of separate fasteners that are removable from the housing.

16. The apparatus of claim 14, further comprising:

the fan assembly including a motor that is attached to the panel in the housing interior bore and a fan that is mounted on the motor for rotation of the fan in the housing interior bore by the motor.

17. The apparatus of claim 14, further comprising:

the side wall having an opening through the side wall to the housing interior bore; and, the panel being attached to the housing covering over the side wall opening.

18. The apparatus of claim 17, further comprising:

the side wall having an input edge surrounding an input opening at the input end of the housing;

the side wall having an output edge surrounding an output opening at the output end of the housing; and, the side wall opening being spaced between the input edge and the output edge.

19. The apparatus of claim 14, further comprising:

the panel having a circular end wall positioned on the panel adjacent the fan assembly, the end wall having an air flow aperture through the end wall.

20. The apparatus of claim 14, further comprising:

the panel having a curved interior flange projecting from the panel edge and a curved exterior flange projecting from the panel edge; and, the slot being defined between the interior flange and the exterior flange.

* * * * *